US006604379B2

(12) United States Patent
Hotta et al.

(10) Patent No.: US 6,604,379 B2
(45) Date of Patent: Aug. 12, 2003

(54) EJECTOR FOR EJECTOR CYCLE SYSTEM

(75) Inventors: Tadashi Hotta, Okazaki (JP); Yukikatsu Ozaki, Gamagori (JP); Hiroshi Ishikawa, Hazu-gun (JP); Hirotsugu Takeuchi, Nagoya (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 10/281,690

(22) Filed: Oct. 28, 2002

(65) Prior Publication Data

US 2003/0079495 A1 May 1, 2003

(30) Foreign Application Priority Data

Oct. 30, 2001 (JP) ..... 2001-332747

(51) Int. Cl.[7] ..... F25B 1/00; F25B 1/06; F25B 7/00

(52) U.S. Cl. ..... 62/500; 62/116; 62/175; 62/191

(58) Field of Search ..... 62/500, 116, 175, 62/191

(56) References Cited

U.S. PATENT DOCUMENTS 3,838,002 A * 9/1974 Gluntz et al. ..... 376/407
5,713,212 A * 2/1998 Barnett et al. ..... 62/116
6,438,993 B2 * 8/2002 Takeuchi et al. ..... 62/500

FOREIGN PATENT DOCUMENTS

JP 57-76300 5/1982

* cited by examiner

*Primary Examiner*—William C. Doerrler
*Assistant Examiner*—Filip Zec
(74) *Attorney, Agent, or Firm*—Harness, Dickey & Pierce, PLC

(57) ABSTRACT

In an ejector used for an ejector cycle system, a nozzle has a first refrigerant passage, a second refrigerant passage, and a third refrigerant passage in this order in a refrigerant flow direction from a refrigerant inlet toward a refrigerant outlet of the nozzle. The first refrigerant passage, the second refrigerant passage and the third refrigerant passage are formed into cylindrical shapes, respectively, each having a constant passage diameter. Further, a pressure increasing portion of the ejector is also formed into a cylindrical shape having a constant passage diameter. Accordingly, the ejector can be readily manufactured in low cost.

10 Claims, 8 Drawing Sheets

EJECTOR FOR EJECTOR CYCLE SYSTEM

CROSS REFERENCE TO RELATED APPLICATION

This application is based on Japanese Patent Application No. 2001-332747 filed on Oct. 30, 2001, the disclosure of which is incorporated herein by reference.

BACKGROUND OF THE INVENTION

1. Field of the Invention:

The present invention relates to an ejector used for an ejector cycle system, which sucks gas refrigerant by a high-speed refrigerant flow jetted from a nozzle.

2. Description of Related Art:

In an ejector cycle system described in JP-U-57-76300, as shown in FIG. 9, an ejector includes a nozzle 40 for converting a pressure energy of high-pressure refrigerant from a radiator to a speed energy, a mixing portion 42 in which gas refrigerant evaporated in an evaporator is sucked by a high-speed refrigerant flow jetted from the nozzle 41, and a diffuser 43 in which the speed energy is converted to the pressure energy so that the pressure of refrigerant is increased while refrigerant discharged from the nozzle 40 and the gas refrigerant from the evaporator are mixed. In the ejector, the nozzle 40 has a taper portion 41 at an inlet side, and the diffuser 43 is formed into a taper shape. Because each inner wall of the taper portion 41 and the diffuser 43 is formed into a conical taper shape, it is difficult to form the hole by using a simple drill. Generally, electrical discharge machining or wire cutting is necessary for forming the hole in the taper portion 41 and the diffuser 43. Accordingly, it is difficult to reduce manufacturing process and product cost.

On the other hand, a taper angel of the taper portion 411 is set at a relative small angle for preventing a large disturbance of the refrigerant flow in the nozzle 40. Therefore, an axial dimension of the nozzle 40 becomes longer.

SUMMARY OF THE INVENTION

In view of the foregoing problems, it is a first object of the present invention to provide an ejector cycle system having an ejector, which can reduce product cost.

It is a second object of the present invention to provide an ejector for an ejector cycle system, which has a reduced axial dimension.

According to a first aspect of the present invention, an ejector used for an ejector cycle system includes a nozzle for decompressing high-pressure refrigerant flowing from a radiator by converting a pressure energy of the high-pressure refrigerant to a speed energy, and a mixing portion in which gas refrigerant evaporated in an evaporator is sucked by a flow of refrigerant jetted from the nozzle, to be mixed with the refrigerant jetted from the nozzle. In the ejector, the nozzle has a first refrigerant passage, a second refrigerant passage, and a third refrigerant passage in this order in a refrigerant flow direction from a refrigerant inlet toward a refrigerant outlet of the nozzle. Further, the first refrigerant passage, the second refrigerant passage and the third refrigerant passage have cylindrical shapes, respectively, each having a constant passage diameter, and the passage diameter of the first refrigerant passage is larger than the passage diameter of the second refrigerant passage. Accordingly, the first refrigerant passage, the second refrigerant passage and the third refrigerant passage can be readily manufactured by a simple cutting method such as drilling. Thus, product cost of the ejector can be reduced.

In the present invention, the passage diameter of the second refrigerant passage can be made smaller than the passage diameter of the third refrigerant passage. Alternatively, the passage diameter of the second refrigerant passage can be made equal to the passage diameter of the third refrigerant passage. Alternatively, the passage diameter of the second refrigerant passage can be larger than the passage diameter of the third refrigerant passage.

Preferably, the mixing portion has a cylindrical passage having a constant passage diameter. In this case, the mixing portion can be readily formed by the simple cutting method such as drilling.

According to a second aspect of the present invention, in an ejector for an ejector cycle system, a nozzle includes a taper portion in which a passage sectional area is reduced toward a downstream refrigerant side to have a throttle portion at which the passage sectional area becomes smallest, and an outlet passage portion connected to the throttle portion at a refrigerant downstream side. Further, the taper portion has a taper angle at a refrigerant inlet side, that is larger than that at a side of the throttle portion. Accordingly, the flow speed of refrigerant can be rapidly increased, and an axial dimension of the nozzle can be relatively reduced. Thus, the axial dimension of the ejector can be effectively reduced.

In this case, the taper angle of the taper portion can be changed stepwise, and the outlet passage portion of the nozzle can be formed into a cylindrical shape having a constant passage diameter.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the accompanying drawings.

First Embodiment

In the first embodiment, the present invention is typically applied to an ejector cycle system for a vehicle air conditioner.

Figure 1:
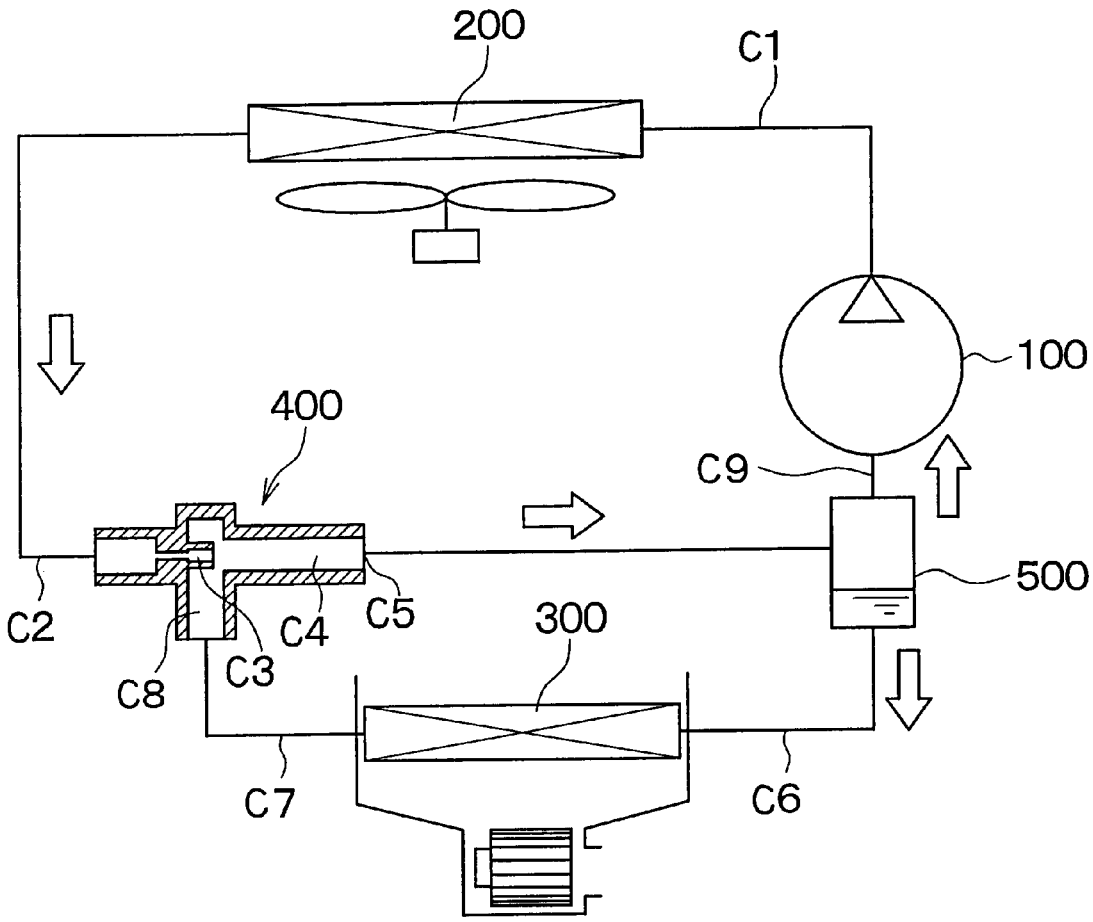
FIG. 1 is a schematic diagram showing an ejector cycle system according to a first embodiment of the present invention.

In FIG. 1, a compressor 100 is driven by a driving source such as a vehicle engine (not shown) to suck and compress refrigerant. In a radiator 200 (i.e., high-pressure side heat exchanger), refrigerant discharged from the compressor 100 is heat-exchanged with air (outside air) outside a passenger compartment, to be cooled. In an evaporator 300 (i.e., low-pressure side heat exchanger), liquid refrigerant in the ejector cycle system is heat-exchanged with air to be blown into a passenger compartment so that air passing through the evaporator 300 is cooled. An ejector 400 decompresses and expands high-pressure refrigerant flowing from the radiator 200 to suck therein gas refrigerant evaporated in the evaporator 300, and converts an expansion energy to a pressure energy to increase the pressure of refrigerant to be sucked into the compressor 100. The refrigerant from the ejector 400 flows into a gas-liquid separator 500, and is separated into gas refrigerant and liquid refrigerant in the gas-liquid separator 500. The separated gas refrigerant in the gas-liquid separator 500 is sucked into the compressor 100, and the separated liquid refrigerant in the gas-liquid separator is sucked to a side of the evaporator 300. The gas-liquid separator 500 is connected to the evaporator 300 through a refrigerant passage. In the refrigerant passage between the gas-liquid separator 500 and the evaporator 300, a flow amount control valve such as a capillary tube, a fixed throttle and a variable throttle can be provided.

Figure 2:
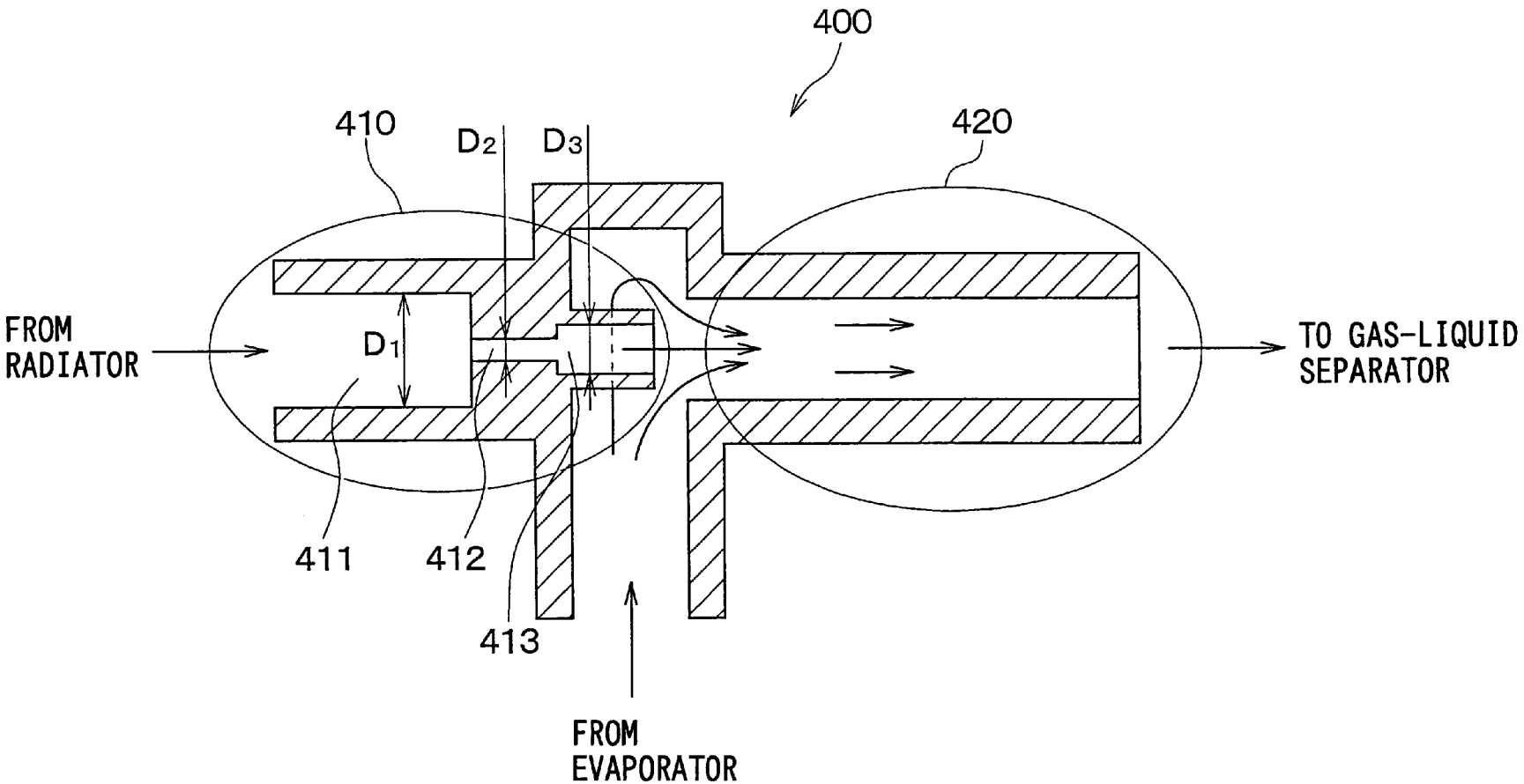
FIG. 2 is an enlarged schematic diagram showing an ejector used for the ejector cycle system according to the first embodiment.

Next, the structure of the ejector 400 is described in detail. As shown in FIG. 2, the ejector 400 includes a nozzle 410 and a mixing portion 420. The nozzle 410 decompresses and expands the high-pressure refrigerant flowing from the radiator 200 by converting a pressure energy (pressure head) of the refrigerant to a speed energy (speed head) thereof. Gas refrigerant evaporated in the evaporator 300 is sucked into the mixing portion 420 by a high-speed refrigerant flow jetted from the nozzle 410, and is mixed with the refrigerant jetted from the nozzle 410 in the mixing portion 420.

The nozzle 410 is constructed to have a first refrigerant passage 411, a second refrigerant passage 412 and a third refrigerant passage 413, in this order from a refrigerant inlet toward a refrigerant outlet. The first refrigerant passage 411, the second refrigerant passage 412 and the third refrigerant passage 413 are formed into cylindrical shapes having predetermined passage diameters D1, D2, D3, respectively. The passage diameter D1 of the first refrigerant passage 411 is larger than the passage diameter D2 of the second refrigerant passage 412 and the passage diameter of the third refrigerant passage 413. Further, the passage diameter D2 of the second refrigerant passage 412 is smaller than the passage diameter D3 of the third refrigerant passage 413.

The ejector 400 is made of a metal material such as a stainless steel, copper and aluminum. After performing a die-casting molding using the metal material, cutting such as drilling is performed for forming the refrigerant passages 411–413 and the mixing portion 420, so that the ejector 400 is manufactured.

Next, operation of the ejector cycle system will be now described. When the compressor 100 starts operation, the gas refrigerant from the gas-liquid separator 500 is sucked into the compressor 100, and the compressed refrigerant is discharged from the compressor 100 into the radiator 200. Refrigerant cooled in the radiator 200 is decompressed in the nozzle 410 of the ejector 400, and gas refrigerant evaporated in the evaporator 300 is sucked into the ejector 400. That is, in the first embodiment, the ejector 400 is also used as a pump for circulating refrigerant between the gas-liquid separator 500 and the evaporator 300.

The refrigerant sucked from the evaporator 300 and the refrigerant jetted from the nozzle 410 are mixed in the mixing portion 420, and thereafter flows into the gas-liquid separator 500. In the mixing portion 420, the refrigerant jet flow jetted from the nozzle 410 and the refrigerant suction flow sucked from the evaporator 300 are mixed so that the sum of the kinetic amount of the driving flow refrigerant (jet flow refrigerant) from the nozzle 410 and the kinetic amount of the suction flow refrigerant from the evaporator 300 are maintained, and the refrigerant pressure is increased in the mixing portion 420. Therefore, in the mixing portion 420, the dynamic pressure of refrigerant is converted to the hydrostatic pressure thereof, and the pressure of refrigerant is increased in the mixing portion 420. Accordingly, the mixing portion 420 functions as a pressure increasing portion in which the pressure of refrigerant to be sucked into the compressor 100 is increased.

On the other hand, because gas refrigerant is sucked from the evaporator 300 into the ejector 400, liquid refrigerant from the gas-liquid separator 500 flows into the evaporator 300 to be evaporated by absorbing heat from air to be blown into the passenger compartment.

Figure 3:
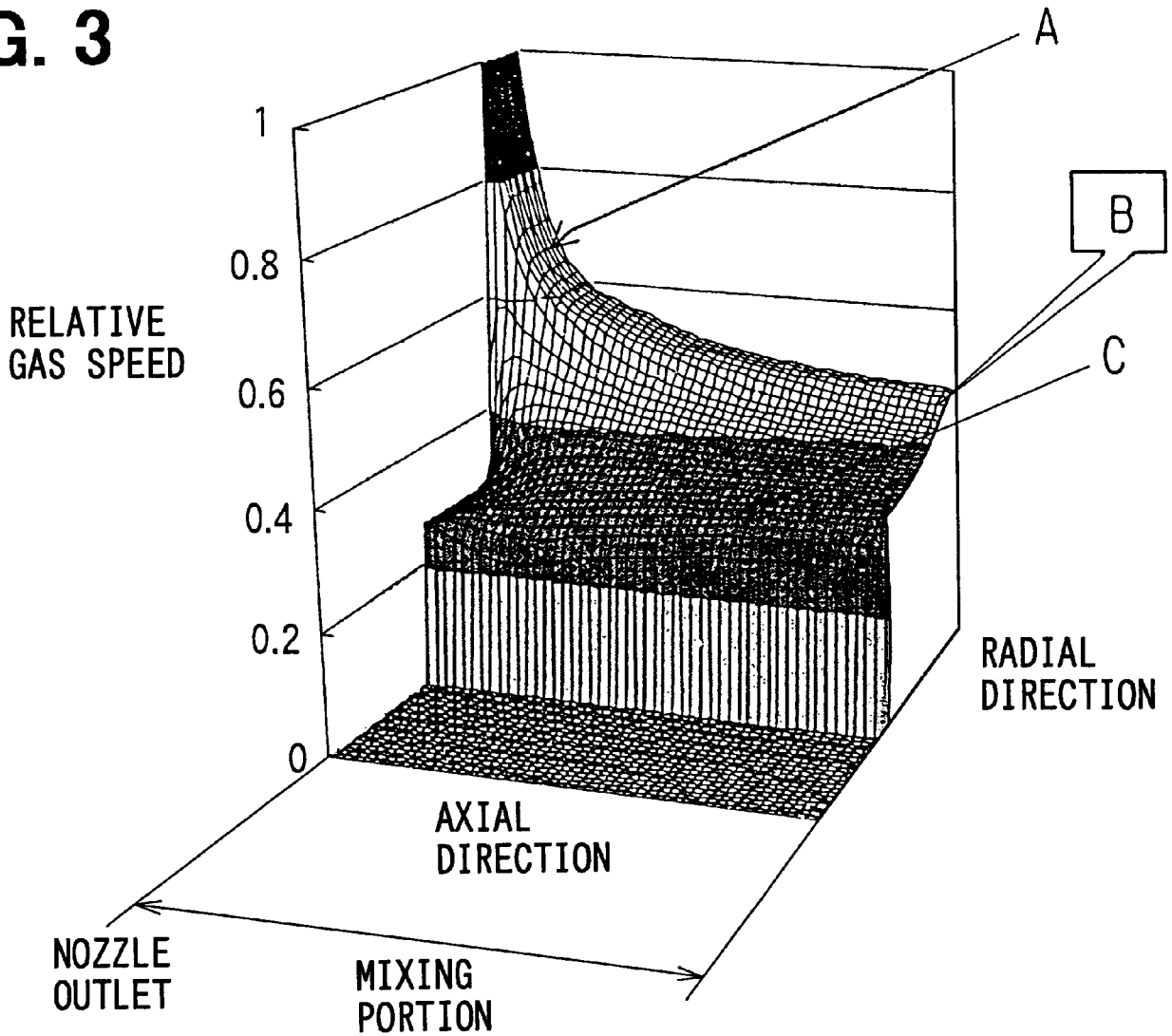
FIG. 3 is a three-dimensional characteristic view showing a relationship between a refrigerant relative flow speed from a refrigerant outlet of a nozzle to a refrigerant outlet of a mixing portion of the ejector, and a radial position in a radial direction from a center in a refrigerant passage section of the ejector, according to the first embodiment.

FIG. 3 is a simulation result showing a relationship between a refrigerant flow speed (relative speed) from the refrigerant outlet of the nozzle 410 to the refrigerant outlet of the mixing portion 420, and a radial position in a radial direction from a center in a refrigerant passage cross-section of the ejector 400. The simulation of FIG. 3 is performed, assuming that the refrigerant flow speed distribution (gas flow speed distribution) is symmetrical relative to a center axial line, and assuming that the refrigerant flow speed at the outlet of the nozzle 410 is 1. In FIG. 3, A indicates a jet-flow gas refrigerant flowing from the nozzle 410, and C indicates a suction gas refrigerant (suction flow gas) sucked from the evaporator 300. As shown in FIG. 3, the flow speed of the jet-flow gas refrigerant discharged from the nozzle 410 becomes lower while the jet-flow gas refrigerant sucks and accelerates refrigerant from the evaporator 300. Therefore, at a refrigerant outlet side of the mixing portion 420, the flow speed decrease of the jet-flow gas refrigerant is nearly finished as shown by B in FIG. 3.

Figure 4:
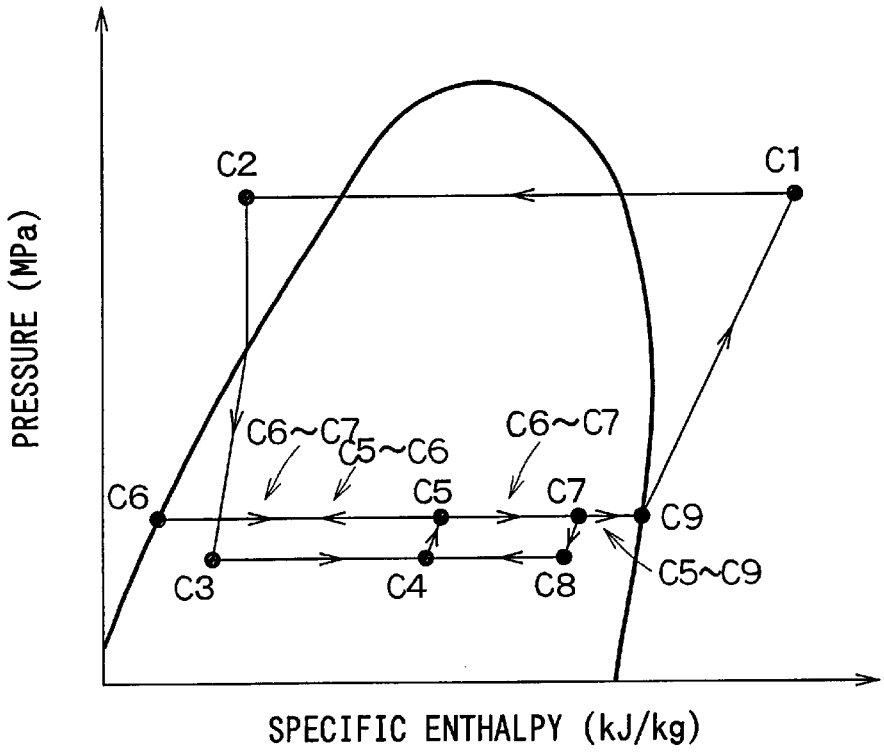
FIG. 4 is a Mollier diagram (p-h diagram) showing an operation of the ejector cycle system according to the first embodiment.

FIG. 4 shows the operation of the ejector cycle. In FIG. 4, the reference numbers C1–C9 indicate operation positions in the ejector cycle system in FIG. 1. Further, FIG. 4 shows an ideal state where a pressure loss generated in refrigerant pipes connecting the compressor 100, the radiator 200, the evaporator 300, the ejector 400 and the gas-liquid separator 500 is omitted.

According to the present invention, the nozzle 410 is formed to have the first, second and third refrigerant passages 411, 412, 413 having certain passage diameters in cross section. That is, each of the refrigerant passages 411, 412, 413 has a simple cylindrical shape, the nozzle 410 can be readily manufactured by simple cutting such as drilling. Accordingly, the ejector 400 can be manufactured in low cost.

In the ejector 400, the refrigerant passages 411, 412, 413 are formed into the cylindrical shapes having different passage diameters, a step portion is formed between adjacent two of the refrigerant passages 411, 412, 413. Therefore, the refrigerant flow is disturbed in the step portion, and a conversion efficiency converting the pressure energy to the speed energy of refrigerant is decreased as compared with a case without the step portion. However, in this embodiment, because liquid refrigerant having a dryness of zero is supplied from the gas-liquid separator 500 to the evaporator 300, a wetted area of refrigerant in the evaporator 300 becomes larger as compared with a vapor compression refrigerant cycle where the refrigerant is decompressed using an expansion valve. Accordingly, in the ejector cycle, heat transmitting efficiency of refrigerant in the evaporator 300 is increased. Thus, in the first embodiment, the ejector 400 can be manufactured in low cost while actual consumed power in the compressor 100 can be reduced as compared with the vapor-compression refrigerant cycle. In the first embodiment, the first, second and third refrigerant passages 411–413 are formed to have a passage diameter ratio (D1:D2:D3) of 20:2:3, for example.

In the above-described embodiment, the passage diameter D3 of the third refrigerant passage 413 is made larger than the passage diameter D2 of the second refrigerant passage 412. However, in the first embodiment, the passage diameter D3 of the third refrigerant passage 413 can be made equal to the passage diameter D2 of the second refrigerant passage 412. Alternatively, the passage diameter D3 of the third refrigerant passage 413 can be made smaller than the passage diameter D2 of the second refrigerant passage 412.

In the ejector cycle system of the first embodiment, fluorocarbon (flon) or carbon dioxide can be used as the refrigerant, for example. When the fluorocarbon is used as the refrigerant in the ejector cycle system, the refrigerant pressure at the high-pressure side is lower than the critical pressure of the refrigerant. On the other hand, when the carbon dioxide is used as the refrigerant in the ejector cycle system, the refrigerant pressure at the high-pressure side is becomes higher than the critical pressure of the refrigerant.

Second Embodiment

Figure 5:
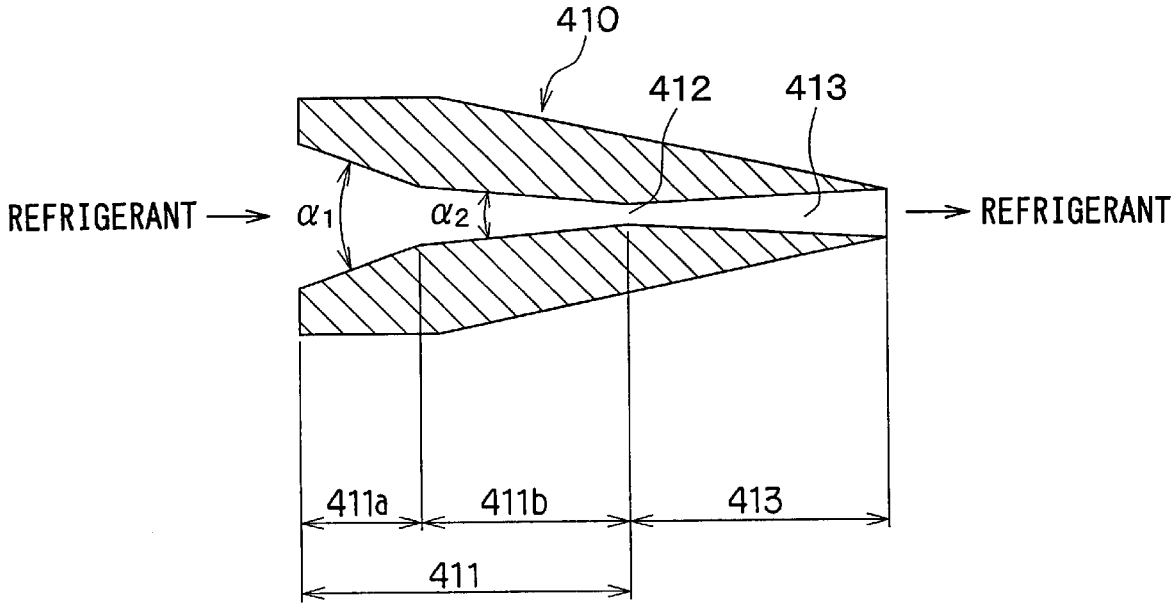
FIG. 5 is a sectional view showing a nozzle of an ejector used for the ejector cycle system according to a second embodiment of the present invention.

The second embodiment of the present invention will be described with reference to FIGS. 5–8. As shown in FIG. 5, in the second embodiment, the sectional shapes of the refrigerant passages 411–413 are changed in an ejector 400 for the ejector cycle system. In the second embodiment, a first refrigerant passage (taper portion) 411 is tapered so that a passage sectional area of the taper portion 411 is reduced gradually from the refrigerant inlet toward a refrigerant downstream side. The passage sectional area of the taper portion 411 is reduced and becomes smallest at a second refrigerant passage (throttle portion) 412. A third refrigerant passage (outlet passage portion) 413 connected to the throttle portion 412 is tapered so that the passage sectional area of the third refrigerant passage 413 is gradually increased toward the refrigerant outlet of the outlet passage portion 413. That is, in the second embodiment, as the nozzle 410, a divergent nozzle (De Laval Nozzle) is used. In FIG. 5, the throttle portion 412 having a smallest passage diameter is formed into a throttle like with a short axial dimension. However, the axial dimension of the throttle portion 412 can be adjusted to be longer. The taper portion 411 is a passage-area reducing portion in which the passage sectional area is reduced from the refrigerant inlet toward the throttle portion 412, and the outlet passage portion 413 is a passage-area increasing portion in which the passage sectional area is increased from the throttle portion 412 toward the refrigerant outlet. The taper portion 411 is formed into a two-step taper shape to have a first taper portion 411*a* at the refrigerant inlet side, and a second taper portion 411*b* at the side of the throttle portion 412. Here, a taper angle $\alpha 1$ of the first taper portion 411*a* is set larger than a taper angle $\alpha 2$ of the second taper portion 411*b*, in the taper portion 411 of the nozzle 410.

Figure 6:
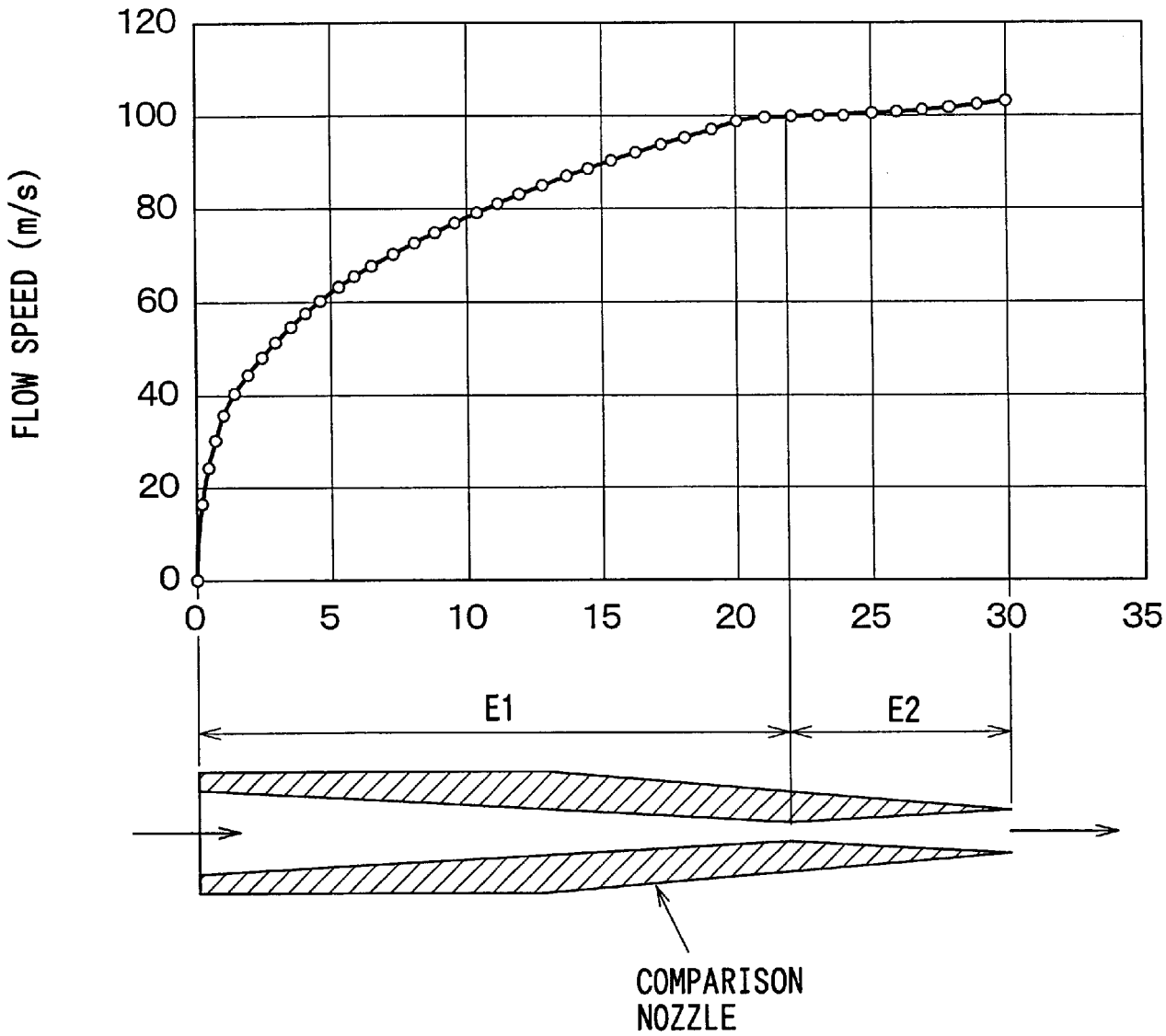
FIG. 6 is a graph showing a change of a refrigerant speed in a comparison nozzle.
Figure 7:
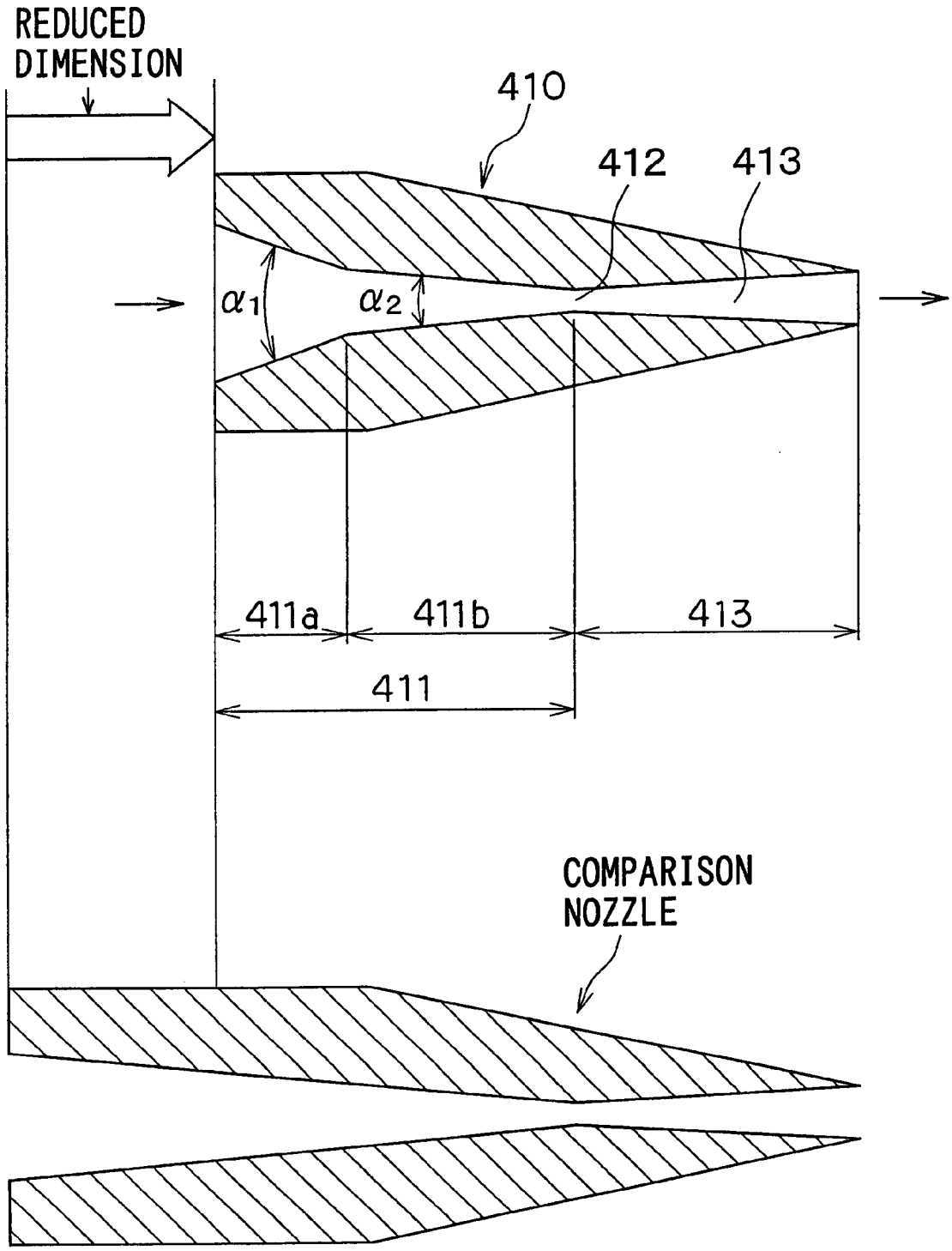
FIG. 7 is a view for explaining the effect of the nozzle in the ejector according to the second embodiment.

FIG. 6 shows a refrigerant flow speed in a comparison nozzle having a constant taper angle in the taper portion. In this case, as shown in FIG. 6, the flow speed of refrigerant around the inlet portion of the taper portion is rapidly increased, and thereafter, the flow speed is relatively slowly increased. After the throttle portion, the flow speed is slightly increased in the outlet passage portion.

In the second embodiment, the taper portion (passage-area reducing portion) 411 is formed to have the first and second taper portions 411*a*, 411*b*, so that the refrigerant flow speed can be more rapidly increased in the nozzle 410. Further, the taper angle $\alpha 1$ of the first taper portion 411*a* is set larger than the taper angle $\alpha 2$ of the second taper portion 411*b*, so that the refrigerant flow speed can be effectively increased. Accordingly, even when the sectional area of the throttle portion 412 is set equal to that of the comparison nozzle, the axial dimension of the nozzle 410 of the second embodiment can be reduced as compared with the comparison nozzle.

In the above-described second embodiment, the taper angle of the taper portion 411 is changed in two steps having two different taper angles. However, the taper portion 411 of the nozzle 410 can be formed into a taper shape having plural steps more than two.

Figure 8:
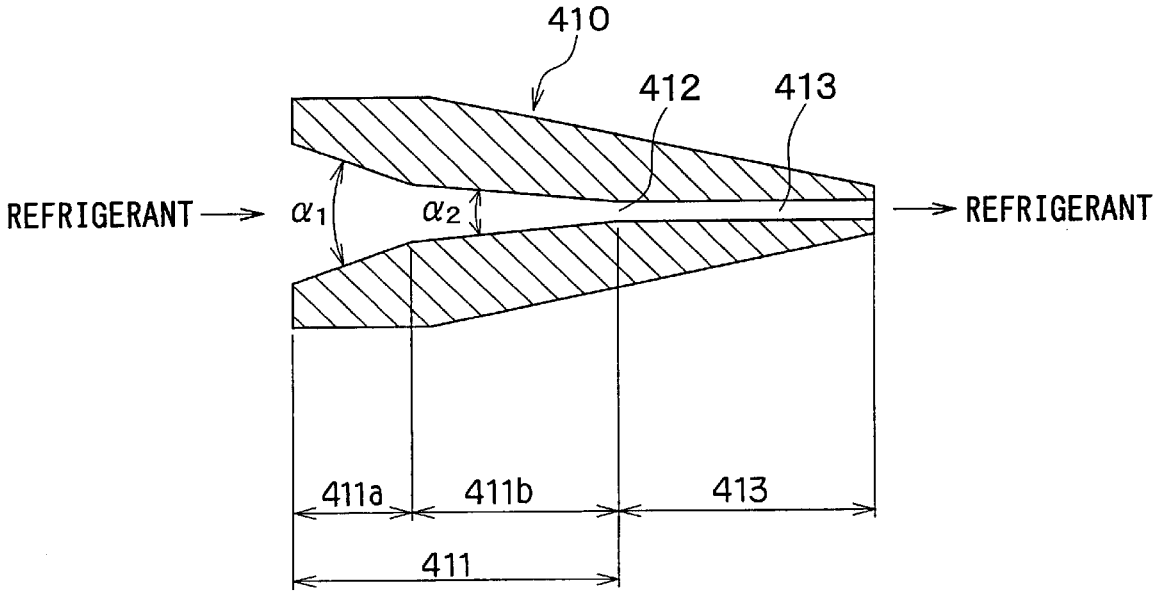
FIG. 8 is a sectional view showing a nozzle of an ejector according to a modification of the second embodiment.
Figure 9:
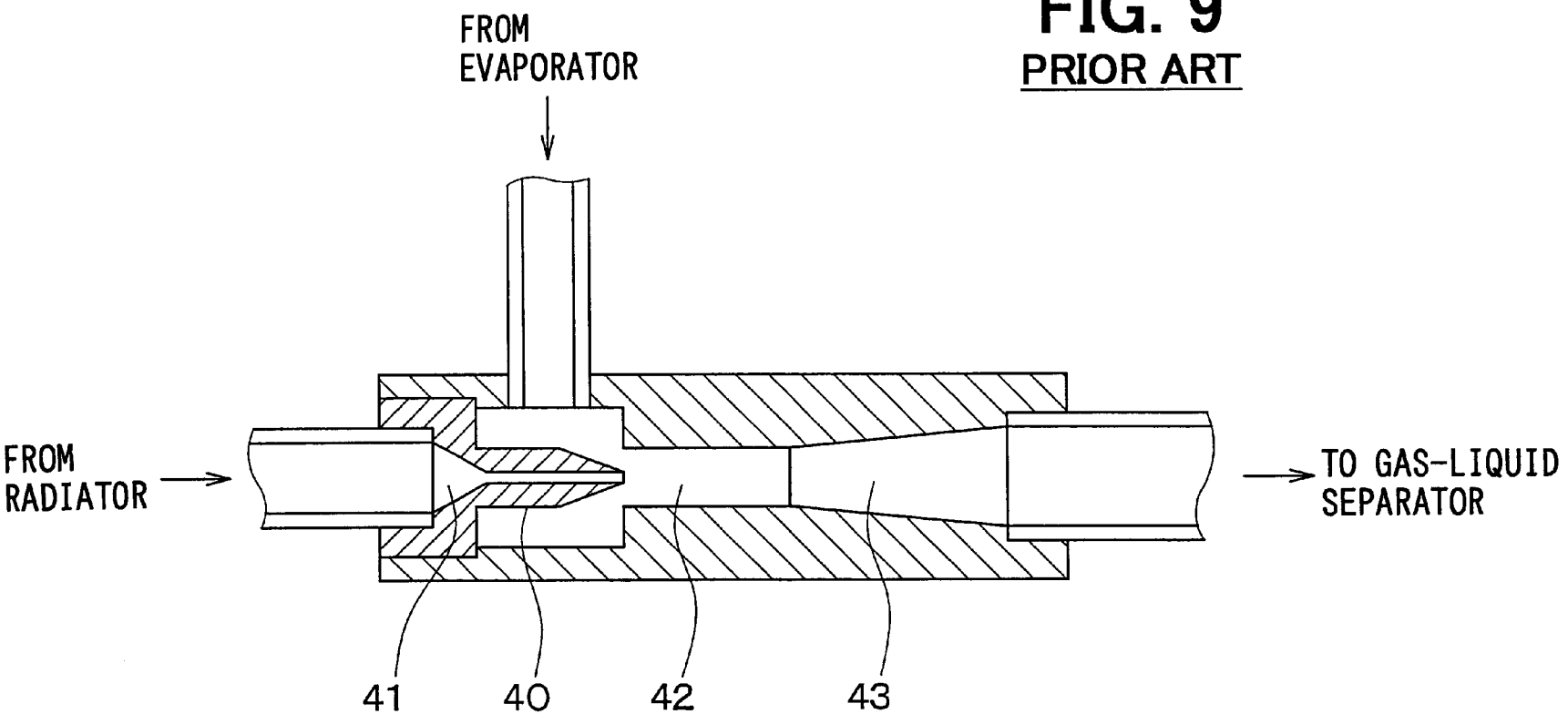
FIG. 9 PRIOR ART
FIG. 9 is a sectional view showing an ejector in prior art.

In FIG. 5, the outlet passage portion 413 (third refrigerant passage) of the nozzle 410 is formed into the taper shape where the passage sectional area is increased from the throttle portion 412 toward the refrigerant outlet. However, the refrigerant flow speed in the nozzle 410 is slightly increased after passing through the throttle portion 412. Therefore, in the second embodiment, as shown in FIG. 8, the outlet passage portion 413 of the nozzle 410 can be formed into a cylindrical shape having a constant passage diameter. In this case, the constant passage diameter of the outlet passage portion 413 can be set equal to that of the throttle portion 412.

Similarly to the above-described first embodiment, the nozzle 410 of the second embodiment can be used for an ejector cycle system where fluorocarbon (flon) and carbon dioxide can be used as the refrigerant, for example.

Although the present invention has been fully described in connection with the preferred embodiments thereof with reference to the accompanying drawings, it is to be noted that various changes and modifications will become apparent to those skilled in the art.

For example, in the above-described embodiments, a taper-shaped diffuser for increasing the refrigerant pressure by converting the speed energy to the pressure energy can be provided at the refrigerant outlet of the mixing portion 420.

In the above-described embodiments of the present invention, the ejector cycle system is used for a vehicle air conditioner. However, the ejector cycle system can be used for an air conditioner for an any compartment, a cooling unit, or a heating unit using a heat pump.

Such changes and modifications are to be understood as being within the scope of the present invention as defined by the appended claims.

What is claimed is:

1. An ejector for an ejector cycle system including a compressor, a radiator, an evaporator and a gas-liquid separator, the ejector cycle system being constructed such that gas refrigerant separated in the gas-liquid separator is supplied to a suction side of the compressor and liquid refrigerant separated in the gas-liquid separator is supplied to the evaporator, the ejector comprising:

a nozzle for decompressing high-pressure refrigerant flowing from the radiator by converting a pressure energy of the high-pressure refrigerant to a speed energy; and a mixing portion in which gas refrigerant evaporated in the evaporator is sucked by a flow of refrigerant jetted from the nozzle, to be mixed with the refrigerant jetted from the nozzle, wherein:

the nozzle has a first refrigerant passage, a second refrigerant passage, and a third refrigerant passage in this order in a refrigerant flow direction from a refrigerant inlet toward a refrigerant outlet of the nozzle;

the first refrigerant passage, the second refrigerant passage and the third refrigerant passage have cylindrical shapes, respectively, each having a constant passage diameter; and the passage diameter of the first refrigerant passage is larger than the passage diameter of the second refrigerant passage.

2. The ejector according to claim 1, wherein the passage diameter of the second refrigerant passage is smaller than the passage diameter of the third refrigerant passage.

3. The ejector according to claim 1, wherein the passage diameter of the second refrigerant passage is equal to the passage diameter of the third refrigerant passage.

4. The ejector according to claim 1, wherein the passage diameter of the second refrigerant passage is larger than the passage diameter of the third refrigerant passage.

5. The ejector according to claim 1, wherein a ratio of the passage diameters of the first refrigerant passage, the second refrigerant passage and the third refrigerant passage is approximately 20: 2: 3.

6. The ejector according to claim 1, wherein the mixing portion has a cylindrical passage having a constant passage diameter.

7. An ejector for an ejector cycle system including a compressor, a radiator, an evaporator and a gas-liquid separator, the ejector cycle system being constructed such that gas refrigerant separated in the gas-liquid separator is supplied to a suction side of the compressor and liquid refrigerant separated in the gas-liquid separator is supplied to the evaporator, the ejector comprising:

a nozzle for decompressing high-pressure refrigerant flowing from the radiator by converting a pressure energy of the high-pressure refrigerant to a speed energy; and a pressure-increasing portion in which the speed energy is converted to the pressure energy so that the pressure of refrigerant is increased while refrigerant jetted from the nozzle and gas refrigerant from the evaporator are mixed, wherein:

the nozzle includes a taper portion in which a passage sectional area is reduced toward a downstream refrigerant side to have a throttle portion at which the passage sectional area becomes smallest, and an outlet passage portion connected to the throttle portion at a refrigerant downstream side; and the taper portion has a taper angle at a refrigerant inlet side, that is larger than that at a side of the throttle portion.

8. The ejector according to claim 7, wherein the taper portion has a taper angle that is changed stepwise.

9. The ejector according to claim 7, wherein the outlet passage portion of the nozzle has a cylindrical shape having a constant passage diameter.

10. The ejector according to claim 7, wherein the outlet passage portion of the nozzle is tapered such that a passage sectional area is gradually increased from the throttle portion toward the refrigerant downstream side.

* * * * *